United States Patent [19]

Komada

[11] Patent Number: 4,563,077

[45] Date of Patent: Jan. 7, 1986

[54] REMOVABLE BELT MECHANISM FOR IMAGE RECORDING APPARATUS

[75] Inventor: Kenya Komada, Yokohama, Japan

[73] Assignee: Ricoh Company, Ltd., Tokyo, Japan

[21] Appl. No.: 738,813

[22] Filed: May 29, 1985

Related U.S. Application Data

[63] Continuation of Ser. No. 455,611, Jan. 4, 1983, abandoned.

[51] Int. Cl.[4] ..... G03G 15/00

[52] U.S. Cl. ..... 355/3 BE; 355/16; 355/3 R

[58] Field of Search ..... 355/3 BE, 3 R, 3 DR, 355/16, 14 R, 3 CH

[56] References Cited

U.S. PATENT DOCUMENTS 3,604,797 9/1971 Szczesniak ..... 355/16
4,364,656 12/1982 Yanagawa ..... 355/3 CH
4,416,536 11/1983 Itoh et al. ..... 355/3 R X

*Primary Examiner*—A. C. Prescott
*Attorney, Agent, or Firm*—David G. Alexander

[57] ABSTRACT

An image recording apparatus which sequentially performs a series of electrostatic or electrophotographic recording steps in accordance with the movement of a recording medium which is shaped as an endless belt. A section of the apparatus adapted to movably pass the belt around a drive roller, idle rollers and a tension roller have a unitary cassette configuration. Chargers, a recording head and other instruments located above the belt cassette are commonly mounted on a single base member. The belt cassette and base constitute an upper unit which is bodily movable away from a housing of the apparatus toward an open position thereof.

2 Claims, 7 Drawing Figures

REMOVABLE BELT MECHANISM FOR IMAGE RECORDING APPARATUS

CROSS REFERENCE TO RELATED APPLICATION

This application is a continuation of copending U.S. patent application Ser. No. 455,611, filed Jan. 4, 1983 now abandoned.

BACKGROUND OF THE INVENTION

The present invention relates to an image recording apparatus of the type which uses an endless recording medium.

In an electrostatic or electrophotographic image recording apparatus of the type described, the recording medium in the form of an endless belt is usually passed around a drive roller and a tension roller which are located at predetermined spaced positions. The tension in the endless belt is controlled by the tension roller so that the belt can be manually moved into or out of its operative position of the rollers.

Meanwhile, arranged around the recording medium are various instruments adapted to sequentially practice various recording steps such as charging, recording (or exposing), developing, transferring and cleaning timed to the movement of the recording medium, as well as various mechanisms for feeding and conveying sheets one by one at a predetermining timing. These units and mechanisms, therefore, obstruct the manual work for attaching or detaching the recording medium to or from the rollers. Also, it is quite difficult to insure the positional accuracy of the recording medium relative to the numerous units arranged therearound when it is attached to the drums after removal.

Additionally, upon a sheet jam, the jamming sheet has to be taken out with the various sections held stationary in their predetermined positions. Difficulty has thus been experienced in settling sheet jams.

SUMMARY OF THE INVENTION

An image recording apparatus embodying the present invention comprises a housing and an upper unit. The upper unit comprises a recording medium member shaped as an endless belt and a plurality of instruments which are arranged above the recording medium member to sequentially perform a series of predetermined recording steps. The upper unit is movable to an open position in which the upper unit becomes spaced from the housing. The upper unit further comprises a support member for integrally supporting the recording medium member and the instruments arranged thereabove. The support member is pivotally mounted on the housing. The recording medium member comprises a belt cassette which is pivotally mounted on the support member in such a manner that when the upper unit is in the open position the belt cassette is pivotable away from the support member to a position at which the belt cassette is spaced from both the instruments and the housing. The recording medium member further comprises an endless belt, a drive roller member for drivably supporting the endless belt and a mechanism for imparting a predetermined tension to the endless belt. The recording medium member further comprises a mechanism for allowing the tension to be automatically removed from the endless belt when the upper unit is moved to the open position.

In accordance with the present invention, an image recording apparatus sequentially performs a series of electrostatic or electrophotographic recording steps in accordance with the movement of a recording medium which is shaped as an endless belt. A section of the apparatus adapted to movably pass the belt around a drive roller, idle rollers and a tension roller have a unitary cassette configuration. Chargers, a recording head and other instruments located above the belt cassette are commonly mounted on a single base member. The belt cassette and base constitute an upper unit which is bodily movable away from a housing of the apparatus toward an open position thereof.

It is therefore an object of the present invention to provide an image recording apparatus which facilitates manual work for moving a recording medium section and its associated instruments into or out of an operative position relative to a housing of the apparatus by forming them as an integral unit, thereby promoting the ease of replacement of the recording medium and removal of jamming sheets.

It is another object of the present invention to provide a generally improved image recording apparatus.

Other objects, together with the foregoing, are attained in the embodiments described in the following description and illustrated in the accompanying drawings.

DESCRIPTION OF THE PREFERRED EMBODIMENTS

While the image recording apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
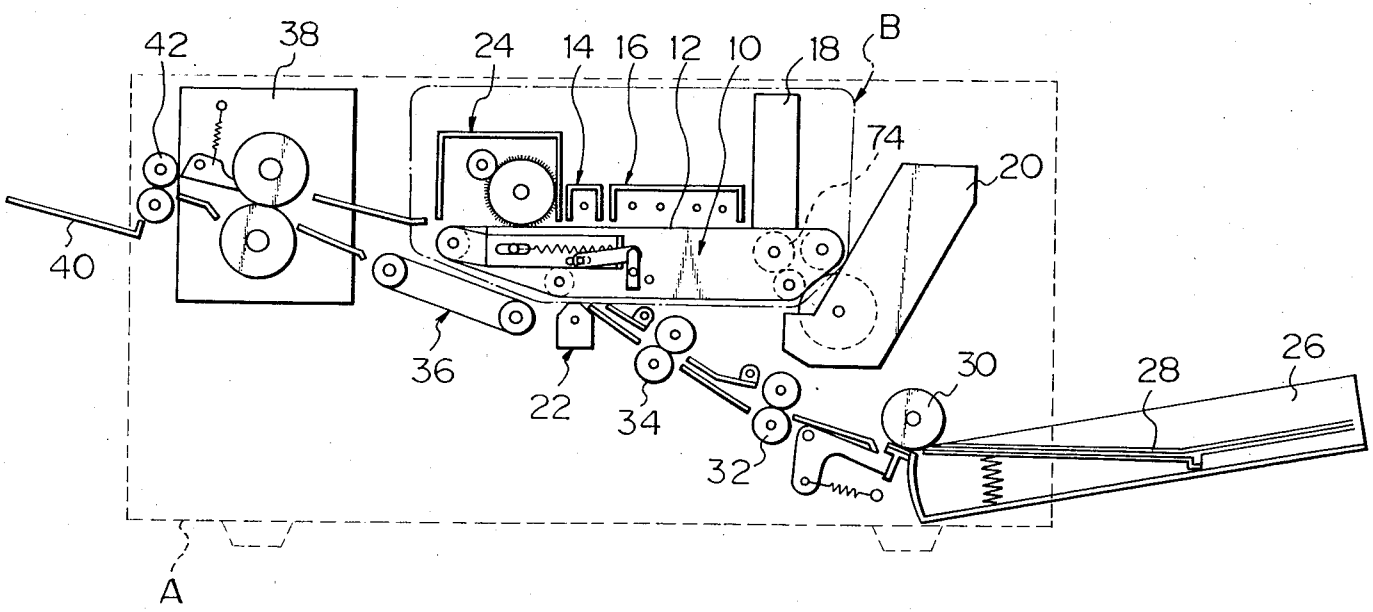
FIG. 1 is a schematic front view of an image recording apparatus embodying the present invention.

Referring to FIG. 1 of the drawings, an image recording apparatus embodying the present invention is shown and includes a body or housing generally designated by the character A. A belt cassette 10 is bodily movable into or out of an operative position relative to the housing and has thereinside a recording medium 12 in the form of an endless belt. An AC charger 14 for discharging and a DC charger 16 for charging are located above the belt 12 to uniformly charge the belt 12 timed to the movement of the belt 12 in the vertical scan direction. A recording head 18 comprises an array of styluses arranged along the horizontal scan direction to face the belt 12. Removably installed in the housing A is a developing unit 20. A transfer charger 22 and a cleaner 24 are also located around the belt cassette 10. These component parts 14–24 constitute an electrostatic recording system which sequentially performs various electrostatic recording steps timed to the movement of the belt 12 in the vertical scan direction. Sheets 28 are stacked in a sheet cassette 26 and fed thereoutof by a feed roller 30, a registration roller 32 and a conveyor roller 34 at such a timing that the leading end of each sheet registers with the leading end of an image area developed on the belt 12. These rollers 30, 32 and 34 constitute a sheet feed system together with the sheet cassette 26. A sheet 28 carrying an image thereon is conveyed by a belt mechanism 36 into a fixing unit 38 which is adapted to fix the image permanently on the sheet. The sheet coming out from the fixing unit 38 is driven by a discharge roller 42 toward a tray 40.

Figure 2:
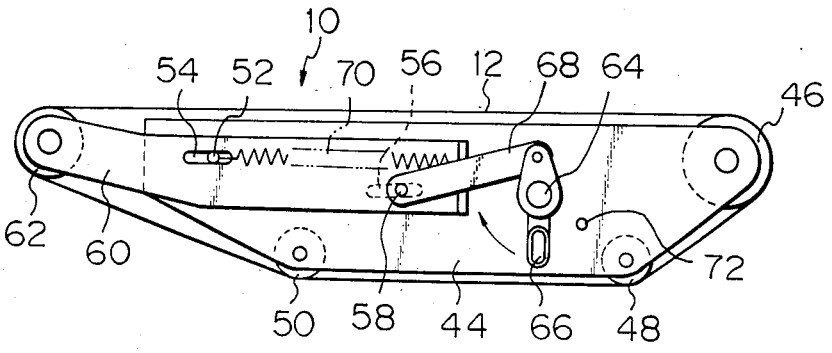
FIG. 2 is a front view of a belt cassette built in the apparatus of FIG. 1.

As shown in detail in FIG. 2, the belt cassette 10 comprises a pair of spaced side plates 44 to which a drive roller 46 and idle rollers 48 and 50 are journalled. Each of the side plates 44 has guide pins 52 and a guide slot 56. A tension lever 60 has a guide slot 54 in which the guide pin 52 on the side plate 44 is engaged and a guide pin 58 engaged in the guide slot 56 of the side plate, thus being slidable horizontally with a predetermined range relative to its associated side plate 44. A tension roller 62 is journalled to the opposite tension levers 60. The belt 12 is passed around the drive roller 46, idle rollers 48 and 50 and tension roller 62. A release lever 66 is rotatably mounted to the side plate 44 through a shaft 64 and operatively connected by a link 68 to the guide pin 58. A tension spring 70 is anchored at one end to the guide pin 52 and at the other end to the tension lever 60. The reference numeral 72 designates a stop for limiting the movement of the release lever 66.

In operation, the tension spring 70 constantly biases the associated tension lever 60 outwardly of the side plate 44 and thereby imparts a predetermined tension to the belt 12 by way of the tension roller 62. When the release lever 66 is rotated clockwise as indicated by an arrow in FIG. 2, it pulls the tension lever 60 inwardly against the action of the tension spring 70. Then, the tension in the belt 12 is cancelled to permit the belt 12 to be readily detached from the cooperative set of rollers. The belt cassette 10 also contains therein a back roller 74 (see FIG. 1) for the recording head 18 and a back roller (not shown) for the cleaner 24.

In the image recording apparatus having the above construction, a characteristic feature of the present invention resides in that the chargers 14 and 16, recording head 18 and cleaner 24 located above the belt cassette 10 are mounted on a common base member so that this unitary structure may be moved away from the housing A together with the belt cassette 10 as an integral upper unit B, as will be described.

Figure 4:
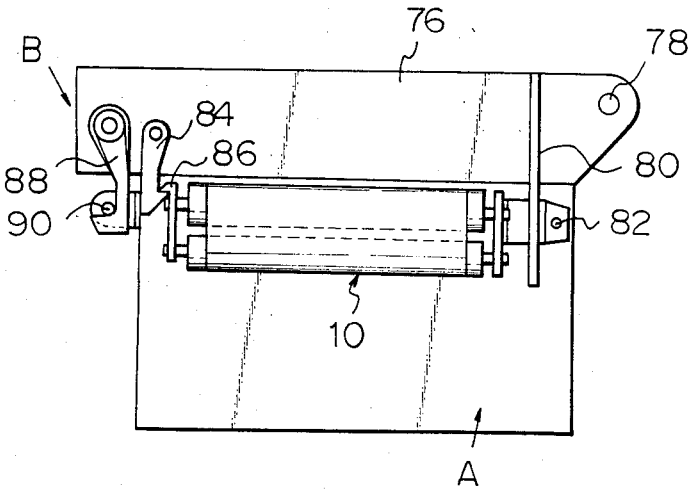
FIG. 4 is a view of an upper unit releasing mechanism as viewed from a side.
Figure 3:
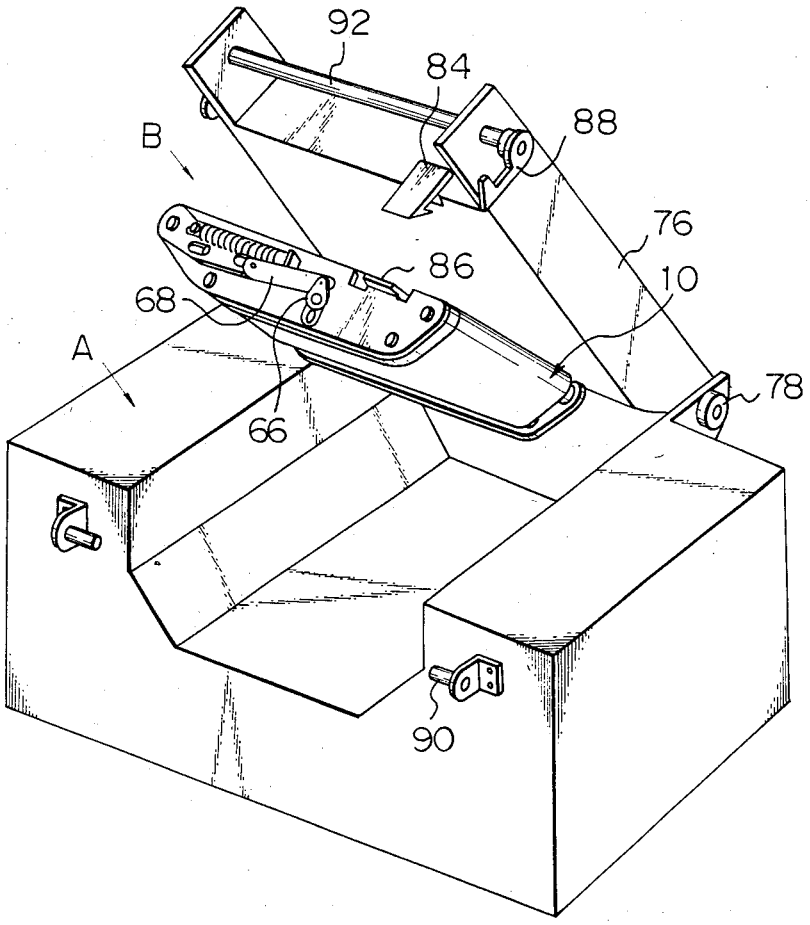
FIG. 3 is a perspective view of an upper unit included in the apparatus of FIG. 1 and held in an open position relative to a housing of the apparatus.

Referring to FIG. 3, there is shown an exemplary construction which allows the upper unit B to be separated from the housing A as desired. As shown, the upper unit B has a base or support member 76 which is rotatably mounted at its rear end to the housing A by a pivot shaft 78, thus being movable upwardly away from the housing A about the shaft 78. As seen in FIG. 4, the rear end of the belt cassette 10 is rotatably mounted by a pivot shaft 82 to a regulator plate 80, which is mounted on the upper unit frame 76. With this arrangement, moving the support 76 upwardly away from the housing A will cause the belt cassette 10 to accompany the support 76 to the position shown in FIG. 3. In this instance, the regulator plate 80 permits the belt cassette 10 to have a position which is shiftable within a regulated range relative to the support 76. The integral movement of the belt cassette 10 with the support 76 is made possible by a lever 84 mounted on the front end of the frame 76 and a coactive hook 86 located in a position of the belt cassette 10 which corresponds to the lever 84. When the upper unit A is moved downwardly to its operative position on the housing A, a lever 88 associated with the frame 76 will be engaged with a pin associated with the housing A so as to fix the upper unit B in the operative position. An arrangement is made such that, in the operative position of the upper unit B, the belt cassette 10 and the chargers 14 and 16, recording head 18 and cleaner 24 housed in the frame 76 are individually located for accurate image recording steps allocated thereto. Furthermore, to facilitate one-hand operation of the upper unit B, a handle bar 92 is positioned at the front end of the frame 76.

To remove the belt 12 from the housing A, it suffices to move the upper unit B upwardly away from the housing A and then release the lever 84 from the hook 86 to position the belt cassette 10 as shown in FIG. 3 relative to the base 76. Meanwhile, a jamming sheet can be easily removed without separating the belt cassette 10 from the support 76, that is, merely by moving the upper unit B bodily upward without releasing the lever 84 from the hook 86. If desired, an arrangement may be made such that opening the upper unit B upwardly locates the support 76 and belt cassette 10 always to the relative position shown in FIG. 3, as long as such an arrangement does not interfere with the jam removal. Then, the coactive lever 84 and hook 86 for fixing the belt cassette 10 to the frame 76 is omissible.

Figure 5:
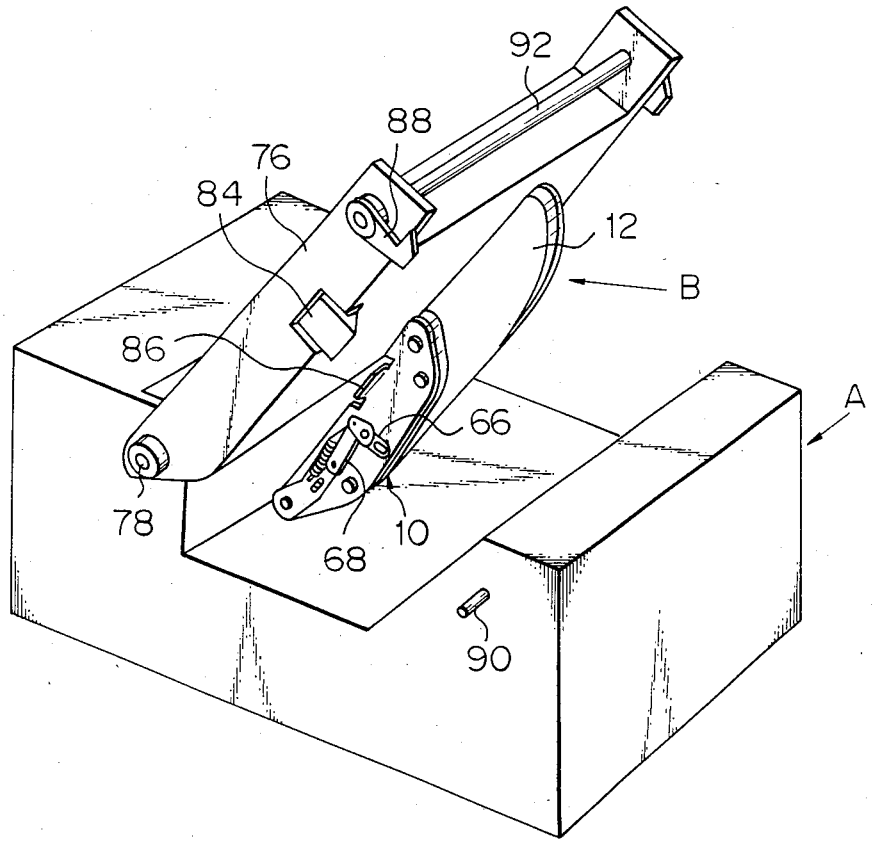
FIG. 5 is a view similar to FIG. 3 but showing another embodiment of the present invention.

Another possible construction for the removal of the upper unit B from the housing A is illustrated in FIG. 5. As shown, the base or support 76 of the upper unit B is movable not longitudinally upward but laterally upward relative to the housing A of the apparatus. It will be seen that the means for mounting the belt cassette 10 to the support 76 is precisely the same as in the construction shown in FIG. 3.

Figure 6:
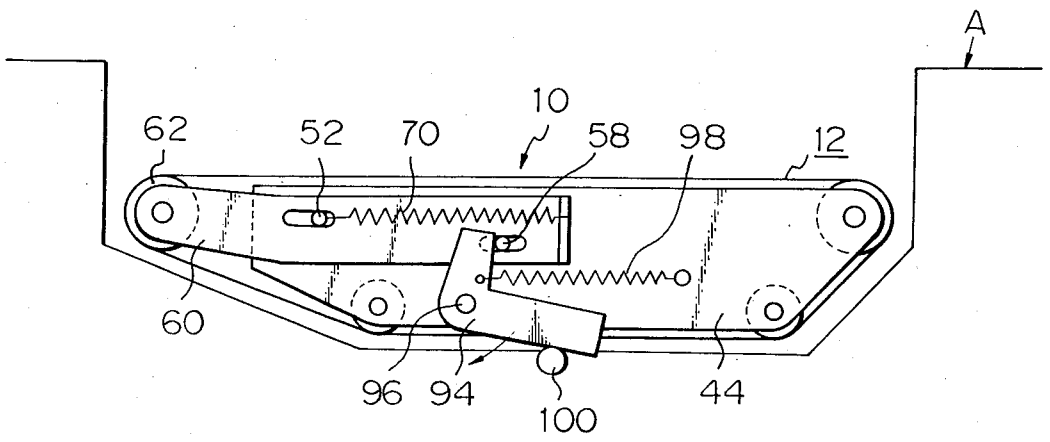
FIG. 6 is a rear end view of a belt cassette section which is furnished with an automatic tension removing mechanism.
Figure 7:
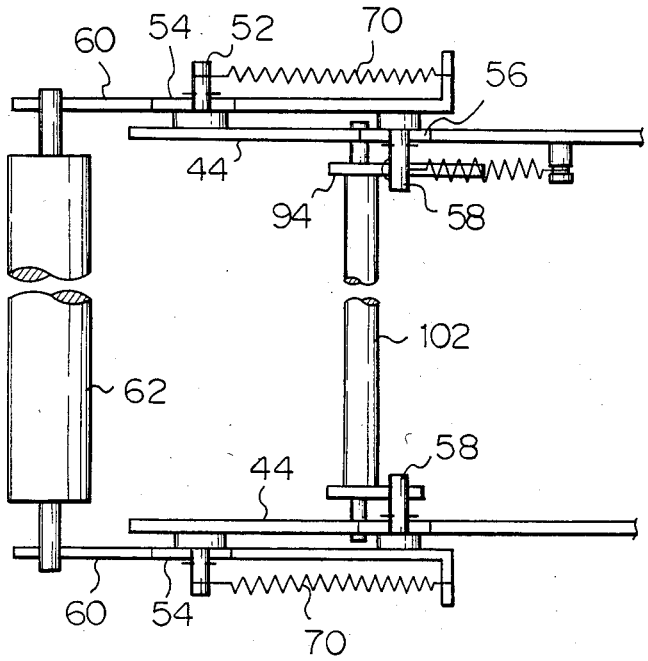
FIG. 7 is a plan view of the automatic tension removing mechanism shown in FIG. 6.

Referring to FIGS. 6 and 7, another embodiment of the present invention is shown which is designed to automatically remove the tension from the belt cassette 10 when the upper unit B is opened to the raised position relative to the housing A. As shown, the release lever 66 and link 68 illustrated in FIG. 2 are replaced by a generally L-shaped lever 94 which is rotatably mounted to the side plate 44 through a pin 96. A tension spring 98 is retained at one end by one arm of the L-shaped lever 94 and at the other end by a pin (not designated) which is studded on the side plate 44. The preload of the spring 98 is greater than that of the spring 70. A stop pin 100 is studded on the housing A so that, when the belt cassette 10 is in the operative position on the housing A, the other arm of the lever 94 remains in abutment with the stop 100 and is thereby prevented from moving any further as would otherwise be caused by the stronger spring 98.

With the construction shown in FIGS. 6 and 7, when the upper unit B is moved upwardly away from the housing A as previously described, the lever 94 is released from the stop 100 and thereby caused to urge the guide pin 58 along the slot 56 under the action of the stronger spring 98. Then, the tension lever 60 is retracted into the belt cassette 10 to automatically free the belt 12 from the tension. It will be noted that the mechanism made up of the lever 94, spring 98 and stop 100 is located at the rear end of the belt cassette 10 and constructed to urge the front and rear guide pins 58 through a shaft 102, so that the belt 12 can be inserted into the belt cassette 10 without any obstruction.

In summary, it will be seen that the present invention provides an image recording apparatus which is advantageous over prior art ones in various aspects. The upper unit B is movable upwardly relative to the housing A to promote easy movement of the belt 12 into or out of the apparatus and easy work for the removal of jamming sheets. Such can be done with the upper unit B kept spaced from the housing A, eliminating the need for an additional space to cut down the system dimensions.

Various modifications will become possible for those skilled in the art after receiving the teachings of the present disclosure without departing from the scope thereof. For example, the image recording apparatus shown and described may be replaced by any other desired apparatus which uses an endless medium such as an inked ribbon, a conveyor belt or a transfer belt which requires periodic replacement.

What is claimed is:

1. An image recording apparatus comprising:

a housing; and an upper unit comprising a recording medium member shaped as an endless belt and a plurality of instruments which are arranged above said recording medium member to sequentially perform a series of predetermined recording steps, said upper unit being movable to an open position in which the upper unit becomes spaced from the housing;

the upper unit comprising a support member for integrally supporting the recording medium member and the instruments arranged thereabove, said support member being pivotally mounted on the housing;

the recording medium member comprising a belt cassette which is pivotally mounted on the support member in such a manner that when the upper unit is in the open position the belt cassette is pivotable away from the support member to a position at which the belt cassette is spaced from both the instruments and the housing;

the recording medium member comprising an endless belt, a drive roller member for drivably supporting the endless belt and a mechanism for imparting a predetermined tension to the endless belt;

the recording medium member further comprising a mechanism for allowing the tension to be automatically removed from the endless belt when the upper unit is moved to the open position.

2. An apparatus as claimed in claim 1, in which the instruments arranged above the recording medium member comprise a charger for discharging, a recording head and a cleaner.

* * * * *